US009022752B2

(12) United States Patent
Arnold

(10) Patent No.: US 9,022,752 B2
(45) Date of Patent: May 5, 2015

(54) LOW-PRESSURE PUMP

(75) Inventor: Felix Arnold, Neckarsteinach (DE)

(73) Assignee: Robert Bosch GmbH, Stuttgart (DE)

( * ) Notice: Subject to any disclaimer, the term of this patent is extended or adjusted under 35 U.S.C. 154(b) by 490 days.

(21) Appl. No.: 12/934,870

(22) PCT Filed: Mar. 27, 2009

(86) PCT No.: PCT/DE2009/000394

§ 371 (c)(1),
(2), (4) Date: Oct. 26, 2010

(87) PCT Pub. No.: WO2009/117993

PCT Pub. Date: Oct. 1, 2009

(65) Prior Publication Data

US 2011/0052438 A1 Mar. 3, 2011

(30) Foreign Application Priority Data

Mar. 28, 2008 (DE) ..... 10 2008 016 293

(51) Int. Cl.

| | |
|---|---|
| ***F04C 2/10*** | (2006.01) |
| ***F04C 18/56*** | (2006.01) |
| ***F04C 23/00*** | (2006.01) |

(52) U.S. Cl.

CPC ..... *F04C 18/565* (2013.01); *F04C 2/102* (2013.01); *F04C 23/001* (2013.01); *F04C 23/008* (2013.01); *F04C 2220/10* (2013.01)

(58) Field of Classification Search

CPC ..... F04C 2/10; F04C 2/102; F04C 23/001; F04C 23/008; F04C 2220/10; F04C 18/565

USPC ..... 417/350, 410.3, 410.4; 418/19, 21, 191, 418/193, 195, 199

See application file for complete search history.

(56) References Cited

U.S. PATENT DOCUMENTS

| | | | | |
|---|---|---|---|---|
| 2,674,952 | A | 4/1954 | Jacobsen | |
| 3,817,666 | A * | 6/1974 | Wildhaber | 418/195 |
| 6,171,076 | B1 * | 1/2001 | Gannaway | 417/350 |
| 7,066,722 | B2 * | 6/2006 | Dreiman et al. | 417/559 |
| 2004/0202557 | A1 | 10/2004 | Suzuki et al. | |
| 2010/0034680 | A1 | 2/2010 | Arnold | |

FOREIGN PATENT DOCUMENTS

| | | | |
|---|---|---|---|
| CH | 449428 | A | 12/1967 |
| DE | 102006012481 | A1 | 9/2006 |
| WO | 2007128303 | A1 | 11/2007 |

* cited by examiner

*Primary Examiner* — Charles Freay
*Assistant Examiner* — Philip Stimpert
(74) *Attorney, Agent, or Firm* — Michael Best & Friedrich LLP

(57) ABSTRACT

The invention relates to a low pressure pump/vacuum pump for gaseous media, comprising two interacting combs the teeth of which are configured as cycloidal components, the duplicate compressor stages being interconnected. A power unit of the pumps/compressors is driven and the power unit of the other pump/compressor, which is arranged coaxially, is entrained via a rotational connection.

6 Claims, 1 Drawing Sheet

LOW-PRESSURE PUMP

CROSS-REFERENCE TO RELATED APPLICATION

This application is a 35 USC 371 application of PCT/DE2009/000394 filed on Mar. 27, 2009.

BACKGROUND OF THE INVENTION

1 Field of the Invention

The invention is based on a rotary piston pump for gaseous media.

2 Description of the Prior Art

In a known rotary piston pump of this type (German Patent DE 42 41 320 C2), it is an essential characteristic that "the teeth of the part cooperating in meshing fashion with the cycloidal part have corresponding tooth combs, which extend along the flanks of the cycloidal part, and the tooth combs have a freely designable radius". As a result, on its use as a pump, a high degree of tightness between the tooth combs of the blocking part and the flanks of the cycloidal part is attained, which is of considerable importance especially when used as a low-pressure pump or vacuum pump. In such a pump having a cycloidal part, providing the power part and the blocking part both in double fashion is already done in this known pump, in which it is also possible for the two work chambers to communicate with one another, even though they are the same size.

It is known that by connecting the work chambers in this way, a corresponding increase in the capacity of each, that is, the pumping capacity, occurs compared to if the work chambers of only one power part were used. It is true that by such a parallel connection, the delivery capacity would be correspondingly increased. However, the pressure would remain the same, assuming it is not controlled in some extra way. Last but not least, the entrainment of the second power part in this known pump, via a common ring acting as a work part, is not unproblematic, quite aside from the fact that producing such a pump, especially if it is to be driven via an electric motor, is complicated.

OBJECT AND ADVANTAGES OF THE INVENTION

The invention is based on the object of developing a rotary piston pump for gaseous media of the type defined at the outset, which has the advantages of the pump mentioned in the generic prior art, but in addition, particularly for large-scale mass production, can be produced economically, and with which a relatively wide pressure range can be covered, especially also for achieving a suitably lower pressure (vacuum), specifically while using two synchronized work chambers. The description and the claims assume an absolute pressure of 0, while by comparison the atmospheric pressure is 1 bar, with vacuum being defined as between absolute pressure of 0 and atmospheric pressure of approximately 1 bar, corresponding to 1000 mbar.

The rotary piston pump of the invention has the advantage over the prior art that it is a two-stage pump, in which the first power part is driven by the rotating part of the electric motor, with which it is solidly connected, while the part of the electric motor that does not rotate jointly is anchored in the motor housing, and the second power part is entrained by the first power part via a coupling and correspondingly rotates with it. The two power parts are rotationally supported via radial bearings in the usual way in the housing and in accordance with the invention in particular in the motor housing of the electric motor.

In an advantageous feature of the invention, between the power parts, an elastic element urging them in the direction of the blocking parts, is disposed, and in particular a helical spring, disposed coaxially with the power parts, serves as the elastic element. By means of the jointly rotating elastic element, the two power parts are pressed with their tooth combs, disposed on the face ends, onto the combs of the corresponding blocking part, and as a result, and particularly because of the rounding off of the tooth combs, a desired form lock is created, which because of its tightness is of particular significance especially in use for gaseous media.

In an additional advantageous feature of the invention, for a torsion lock between the power parts, a plug-in coupling is used, which permits an axial relative motion of the parts. As a result, on the one hand the effect of the elastic element is preserved, and on the other, coupling is made possible at low effort and expense for production and assembly.

In an additional feature of the invention, the motor housing, which receives the motor armature and set of magnets of the electric motor, is closable on both face ends by the pump housings that receive the blocking part and power part, respectively, which once again not only makes an extremely economical production and assembly possible but above all greatly simplifies future servicing as well.

In an additional advantageous feature of the invention, the first pump, with its first power part driven directly by the electric motor, has a greater volumetric capacity than the second pump, driven at the same rpm, with its second power part, and by connecting the pumps in line with one another, a two-stage pump is the overall result. As a result, for instance in use as a lower-pressure pump (vacuum pump), the pump outlet of the second pump communicates with the atmosphere, and its inlet communicates with the outlet of the first pump.

In an additional feature of the invention, the outlet and outlet of the first and second pumps communicate with one another via the annular chamber formed in the electric motor between the coil and the armature.

In a feature of the invention pertaining to the use of the rotary piston pump of the invention, the pump serves as a vacuum pump for a brake booster of a service brake system of a motor vehicle; toward the inlet of the first pump, there is a line connection in the corresponding pump housing for a line to the brake booster. By way of a brake booster of this kind, in a known way the force exerted by the driver's foot on the brake pedal is boosted, without impairing a sensitive graduation of the brake force. While until now in Otto engines the intake tube pressure has usually been used for this purpose, in diesel engines an extra vacuum pump was used for actuating a brake booster, and the reinforcing force is proportional to the force exerted by the driver's foot. It is definitive that by means of the invention, extremely low pressures of approximately 100 mbar are attainable.

Further advantages and advantageous features of the invention can be learned from the ensuing description, the drawings, and the claims.

BRIEF DESCRIPTION OF THE DRAWINGS

One exemplary embodiment of the subject of the invention is shown in the drawings and described in further detail hereinafter in conjunction with the drawings, in which.

DESCRIPTION OF THE PREFERRED EMBODIMENT

Figure 1:
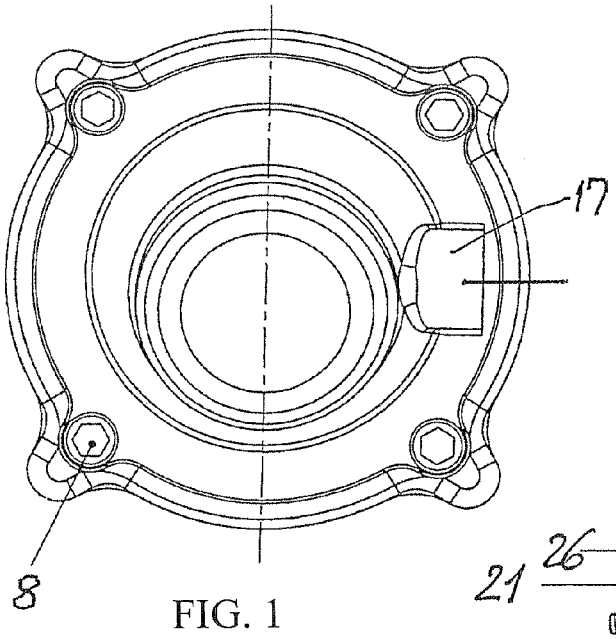
FIG. 1 shows a longitudinal section through a rotary piston pump of the invention.

In the rotary piston pump of the invention, shown in FIG. 1, in a cylindrically embodied electric motor housing 1 there is a rotatable set of magnets 3; this set of magnets is supported rotatably toward the motor housing 1 via ball bearings 4. The face ends of the motor housing 1 are adjoined by the housings 5 and 6 of individual pumps 9 and 10, which have partly spherical interiors; these pump housings 5 and 6 are screwed onto the face ends of the motor housing 1 and are sealed off from the exterior of the housings 1, 5, 6 via O-ring seals 7. The axes of the partly spherical interiors of the individual pumps coincide with the axis of the electric motor. For securing the pump housings 5, 6 to the electric motor housing 1, screws 8 are used, which make fast dismantling possible.

The two individual pumps 9 and 10 disposed in the pump housings 5 and 6 have a different volumetric capacity; specifically, the volumetric capacity of the first pump 9 is greater than that of the second pump 10. Both pumps 9 and 10 have the same positive displacement system, of the kind known from the prior art mentioned at the outset. In each case there is one power part 11, driven by the electric motor, of somewhat greater volumetric capacity and one power part 12 of by comparison somewhat lesser volumetric capacity, and one blocking part 13 of somewhat greater volumetric capacity and one blocking part 14 of somewhat lesser volumetric capacity. The blocking parts 13 and 14 are rotatably supported in the pump housings 5 and 6 on ball bearings 15.

The power parts 11 and 12 are disposed coaxially with the electric motor, while conversely the blocking parts 13 and 14 are supported at a defined angle to this axis of rotation, in order thereby to achieve the requisite change in volume of the pump work chambers upon rotation, namely an increase or decrease during rotation, and the axes of rotation of these blocking parts intersect with the axis of the power parts or of the electric motor. The basic function of this kind of rotary piston machine can be learned from German Patent DE 42 41 320 C2. In FIG. 1 of the present application, for the sake of simplicity, the two associated pumps have been shown in a position in which the work chamber normally present between the power part and the blocking part is not apparent in the sectional plane selected there. However, the power part 11 is connected in rotationally locked fashion to the motor armature 2 and has a rotary coupling, not shown, for jointly rotating the power part 12 of the pump 10. This may be a rotary coupling of the most various kinds—what is definitive is that it permits an axial movability relative to the set of magnets, so that via a helical spring 16, disposed between the power parts 11 and 12, the two power parts are urged toward the blocking parts 13, 14 associated with them. As a result of this axial load, an improved form lock is attained between the flanks and tooth combs of the teeth facing one another at the face ends.

The greater volumetric capacity of the first pump 9 is attained by providing that the pumping parts, namely the power part 11 and the blocking part 13, have a greater diameter in the spherical region than the corresponding power part 12 and blocking part 14 in the second pump 10 of lesser volumetric capacity. The pumping capacity with regard to the first pump 9 is greater, because of the greater volumetric capacity, than that of the downstream second pump 10, which in turn communicates on its outlet side with the atmosphere and on its inlet side with the outlet of the pump 9.

Figure 2:
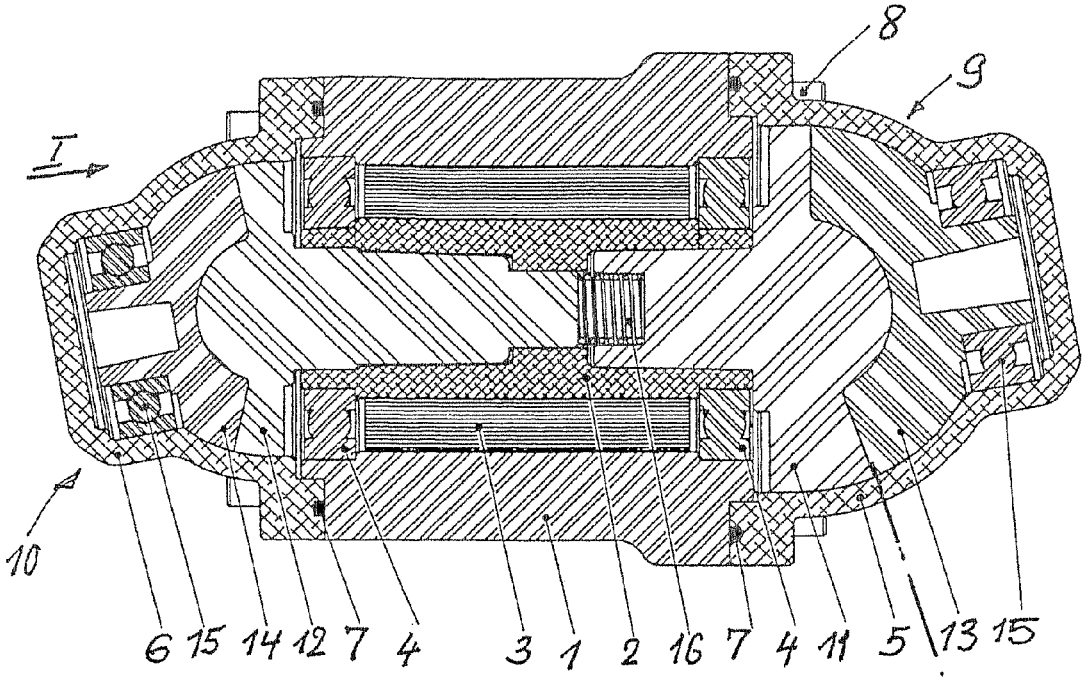
FIG. 2 shows a view of the rotary piston pump of FIG. 1 in the direction of the arrow I in FIG. 1.

As shown in FIG. 2, this second pump 10 has an outlet connection 17 with the atmosphere. The first pump, as indicated by dot-dashed lines, communicates on the inlet side with a vacuum brake booster, shown in FIG. 3, of a motor vehicle. For that kind of brake booster, the pump is intended to generate at least 500 mbar. By way of this kind of vacuum brake booster, the force exerted by the driver's foot is boosted. The reinforcing force increases, upon actuation of the brake, in proportion to the force exerted by the driver's foot, up to the so-called modulation point. From that point on, the reinforcing force does not increase further.

Figure 3:
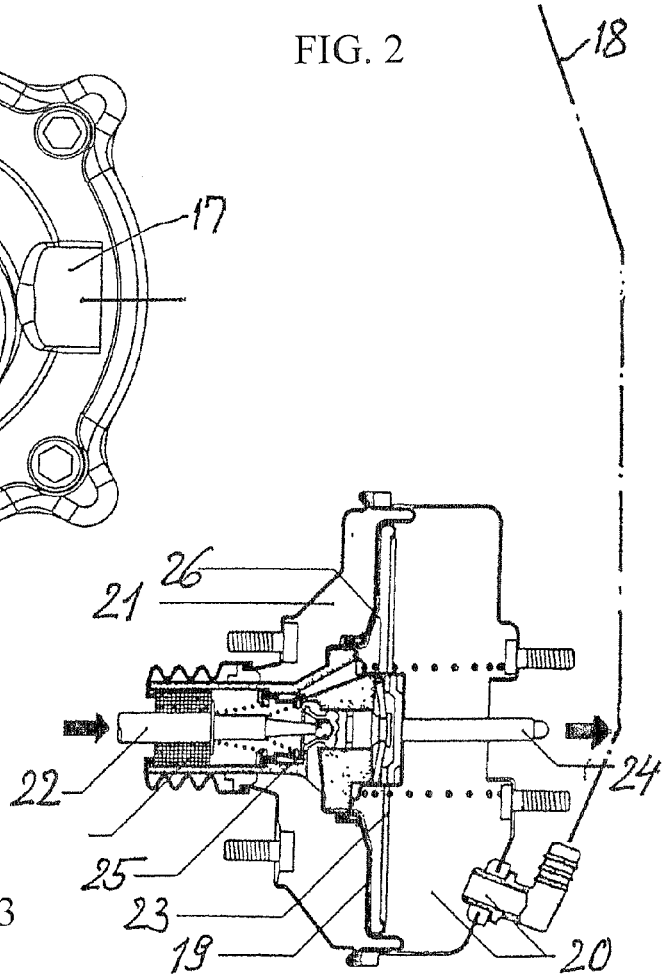
FIG. 3 shows a known vacuum brake booster in longitudinal section, but on a different scale, as a possible application of the invention.

The brake booster shown in FIG. 3, taken from a brochure, is constructed as follows. A diaphragm 19 divides an underpressure chamber 20 (actually a chamber of low pressure), into which the line 18 (indicated by the dot-dashed lines) of the first pump discharges, from a work chamber 21. A piston rod 22 transmits the introduced force exerted by the driver's foot onto a work piston 23, while the boosted brake force acts on the thrust rod 24 on the master cylinder, not shown. When the brake is not actuated, the underpressure chamber 20 and the work chamber 21 communicate with one another via conduits in the valve housing. By way of the line 18, a lower pressure prevails in both chambers. As soon as a braking event begins, the piston rod 22 moves toward the underpressure chamber 20 and presses the cuff of a double valve 25 against the valve seat. Thus the underpressure chamber 20 and the work chamber 21 are disconnected from one another. Since upon further motion of the piston rod 20, a reaction piston 26 lifts from the cuff of the double valve 25, atmospheric air flows into the work chamber 21. Now, a higher pressure prevails in the work chamber than in the underpressure chamber. The atmospheric pressure acts via the diaphragm 19 on the diaphragm plate on which the diaphragm rests. Since the valve housing is entrained by the diaphragm plate in the direction of the underpressure chamber, the result is a reinforcement of the force exerted by the driver's foot. Now, the force exerted by the driver's foot and the reinforcing force press on the diaphragm plate counter to the force of the compression spring. As a result, the thrust rod 24 moves and transmits the initial force. After the termination of the braking event, the underpressure chamber 20 and the work chamber 21 communicate with one another again, so that the same pressure prevails in both chambers. (The text of this paragraph has been taken from the brochure of a manufacturer of such brake boosters and serves solely to explain the necessity and use of vacuum pumps).

All the characteristics mentioned in the description, recited in the ensuing claims, and shown in the drawings can be essential to the invention both individually and in arbitrary combination with one another.

The foregoing related to the preferred exemplary embodiment of the invention, it being understood that other variants and embodiments thereof are possible within the spirit and scope of the invention, the latter being defined by the appended claims.

The invention claimed is:

1. A rotary piston pump for gaseous media, comprising:

an axially and radially supported power part, embodied as a spherical segment of a spur tooth;

a blocking part of a same radial sealing diameter, also embodied as a spherical segment of a spur tooth and driven by the power part;

work chambers between the power part and the blocking part, the power part and blocking part are guided radially sealingly in a pump housing;

the pump, formed of the power part and blocking part, is present in double fashion in each case, which double fashion pumps are driven in common, and the work chambers thereof can be made to communicate with one another, wherein doubly present power parts are disposed coaxially on a drive side, the first power part is driven by a drive mechanism disposed on the drive side, likewise coaxially, in a housing, and the second power part is rotated in rotationally locked fashion by the first power part, wherein between the power parts, an elastic element urging the power parts toward the blocking parts is disposed, and wherein a helical spring, disposed coaxially with the power parts, serves as the elastic element.

2. The rotary piston pump as defined by claim 1, wherein for a torsion lock between the power parts, a plug-in coupling is used, which permits an axial relative motion of the parts.

3. The rotary piston pump as defined by claim 1, wherein the housing, receiving a motor armature and a set of magnets, is embodied as extensively cylindrical, and has face ends which are closable by each pump housing.

4. The rotary piston pump as defined by claim 3, wherein an annular chamber formed in the drive mechanism between the set of magnets and the motor armature or housing serves as a communication with an outlet of a first pump and an inlet of a second pump.

5. The rotary piston pump as defined by claim 1, wherein each blocking part and each power part is disposed in rotary bearings in each housing.

6. The rotary piston pump as defined by claim 1, wherein a first pump of the double fashion pumps, with a first blocking part and a first power part, has a greater volumetric capacity than a second pump of the double fashion pumps, driven at the same rpm, having a second power part.

* * * * *